United States Patent [19]

Smith

[11] 4,375,957

[45] Mar. 8, 1983

[54] CLEANING SYSTEM FOR CONTINUOUS YARN HEAT SET MACHINE

[76] Inventor: Kenneth L. Smith, 101 E. Indiana Ave., Lafayette, Ga. 30728

[21] Appl. No.: 280,109

[22] Filed: Jul. 2, 1981

[51] Int. Cl.[3] ..... F24D 23/02; F24D 23/00

[52] U.S. Cl. ..... 432/2; 28/281; 134/22.1; 432/75

[58] Field of Search ..... 432/2, 59, 75; 28/281, 28/173; 134/22.1

[56] References Cited

U.S. PATENT DOCUMENTS

| | | | |
|---|---|---|---|
| 417,019 | 12/1889 | Gordon | 432/2 |
| 2,844,495 | 7/1958 | Long | 28/173 X |
| 3,667,093 | 6/1972 | Culpepper | 28/173 |
| 3,860,018 | 1/1975 | Reiter | 134/22 R |
| 3,972,176 | 8/1976 | Lawson, Jr. et al. | 28/281 |
| 4,073,664 | 2/1978 | Zwirlein | 134/18 |
| 4,106,950 | 8/1978 | Grismer | 134/10 |
| 4,148,668 | 4/1979 | Stewart, Jr. | 134/22 C |

*Primary Examiner*—John J. Camby

*Attorney, Agent, or Firm*—Thomas & Kennedy

[57] ABSTRACT

A flow of cleaning fluid is directed into the lower ends of the exhaust stacks of a yarn heat set machine, with the cleaning fluid being directed alternately into the stacks at one end of the yarn path and then into the stacks at the other end of the yarn paths for a predetermined time period, and then cleaning fluid is directed alternately into one cross manifold and then into the other cross manifold for the exhaust stacks for a second predetermined time period, and then cleaning fluid is directed into the fan of the yarn heat set machine for a third time period. Preferably, the cleaning cycle is initiated when the yarn heat set machine is hot from its normal operation.

7 Claims, 6 Drawing Figures

CLEANING SYSTEM FOR CONTINUOUS YARN HEAT SET MACHINE

1. Field of the Invention

This invention relates to a cleaning system for a continuous yarn heat set machine which includes a housing that defines parallel paths therethrough for the continuous movement of yarn. Hot air and steam is continuously circulated about the yarn in the housing to heat set the yarn, with a portion of the hot gases being continuously exhausted from the housing.

2. Background of the Invention

After yarn has been manufactured, it usually has a finish applied thereto for the purpose of reducing friction between the yarn and the equipment for handling the yarn. Usually, the finish applied to yarn includes oil, but can comprise various other substances.

In most instances it is desirable to heat set yarn before the yarn is woven into cloth or otherwise used. A typical heat set machine includes the continuous yarn heat set machine known as a "Suessen" as manufactured by Schurr, Stahlecker & Grill, GmbH, wherein unfinished yarn is wound about conveyor tapes and moved with the conveyor tapes through an open ended housing, and heated moist air is circulated about the yarn as it moves through the housing. The yarn tends to give up most of its finish during the heat setting operation, and the oils from the finish are exhausted with the exhaust gas to the atmosphere or elsewhere.

In many instances the continuous yarn heat set machines run twenty-four hours per day and seven days per week, depending upon the demand. The oils and other contaminants from the yarn tend to accumulate on some of the surfaces in the yarn heat set machine, particularly in the stacks, cross manifolds, header conduits and fan that are used to expel the exhaust from the housing of the heat set machine. As the oils and other contaminants accumulate on the surfaces of the heat set machine and reduce the space in the flow passageways through the machine, the flow of hot gases through the machine tends to diminish, and the operation of the machine must be terminated and the machine cleaned. In the past, the cleaning procedure required two men to dismantle and clean the machine, as by removing the exhaust stacks, cross manifolds, header conduits, fan and other elements, by transporting these elements to a remote location outside of the operation area of the machine, and by hand cleaning the surfaces of the machine. After these elements of the machine had been cleaned, they had to be returned to the machine and reassembled on the machine. Since the typical yarn heat set machine operates at about 400° F., depending upon the type of yarn to be treated in the machine, the machine would have to cool for at least 45 minutes prior to being dismantled, and when the machine was reassembled, it would have to be warmed up until its various chambers reached proper operating temperature. The warm-up time for a machine typically ranges from 45 minutes to 1½ hours.

While it is desirable to clean the typical continuous yarn heat set machine about once a month when the machine is run continuously, some of the machines would be permitted to run longer without cleaning because so many man hours are required to dismantle, clean and reassemble the machine.

SUMMARY OF THE INVENTION

Briefly described, the present invention comprises a method and apparatus for cleaning a continuous yarn heat set machine while the machine is at normal operating temperatures and is in operation, with the exhaust fan, recirculation fans and steam injection system in normal operation, and without requiring cooling and reheating the machne and without requiring the machine to be dismantled. The machine comprises a housing which defines a plurality of parallel yarn processing paths therethrough and an air circulation system that circulates steam-saturated air about the yarns moving through the yarn processing paths. During a cleaning cycle cleaning fluid is sequentially directed into the lower portions of the exhaust stacks at each end of the yarn processing paths, then into the cross manifolds, and then into the header conduits and fan at programmed time intervals in a cleaning cycle so as to progressively clean that surfaces of the exhaust system of the machine. For example, cleaning fluid is directed alternately into the lower ends of the exhaust stacks at one side of the housing and into the lower ends of the other exhaust stacks at the other side of the housing for a predetermined time period and at rates which permit the flow of gas induced by the exhaust fan to carry the cleaning solution through the exhaust system. After the cleaning cycle for the exhaust stacks is over, cleaning fluid is then directed alternately in the cross manifolds at the upper ends of the exhaust stacks for a second predetermined time period at a rate which permits the flow of gas induced by the exhaust fan through the cross manifolds to move the cleaning fluid on through the exhaust systems. After the cleaning cycle for the cross manifolds has been completed, cleaning fluid is directed into the fan. Thus, a progressive wash down of the exhaust system is accomplished in a very short time duration and without terminating the injection of steam into the housing and without terminating the flow of circulating air through the housing, so that the temperature of the system is not radically changed and yarn to be treated can be directed back through the system immediately after the cleaning cycle has been completed.

Thus, it is an object of this invention to provide a cleaning system for a continuous yarn heat set machine whereby the exhaust system of the yarn heat set machine can be cleaned while the machine is hot and substantially without changing the operating temperatures of the machine.

Another object of this invention is to provide a method and apparatus for cleaning continuous yarn heat set machines and the like whereby the heat from normal operation of the machine can be retained in the machine while the machine is cleaned.

Another object of this invention is to provide a method and apparatus for cleaning yarn heat set machines whereby the machine does not have to be dismantled during the cleaning procedure, which requires a minimum of operator attention, which provides a substantially uniform cleaning procedure for each such yarn heat set machine, and which requires a very small amount of cleaning liquid.

Other objects, features and advantages of the present invention will become apparent upon reading the following specification, when taken in conjunction with the accompanying drawings.

DETAILED DESCRIPTION

Figure 1:
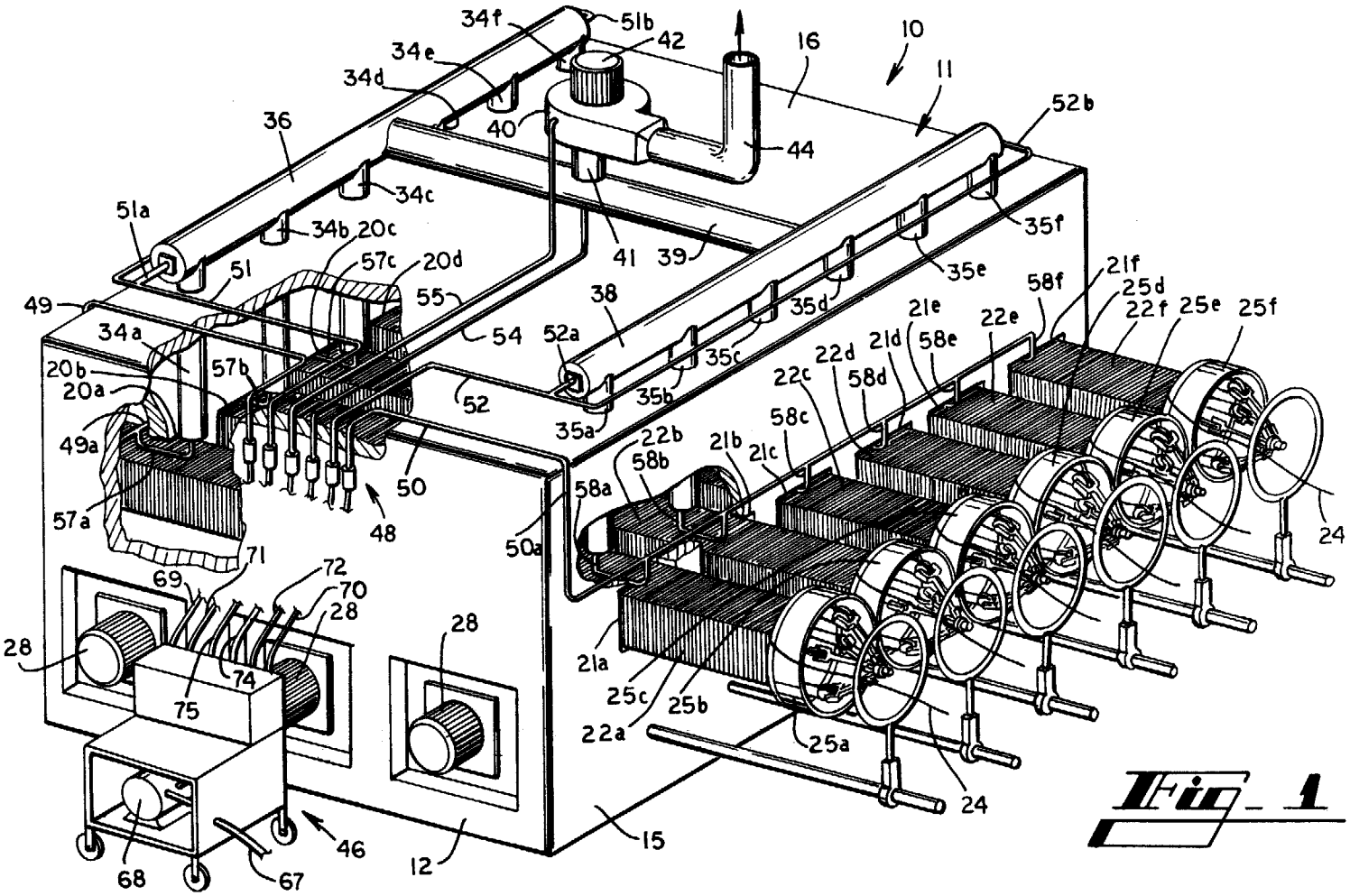
FIG. 1 is a schematic perspective illustration, with parts broken away, of a continuous yarn heat set machine and the cleaning system.
Figure 2:
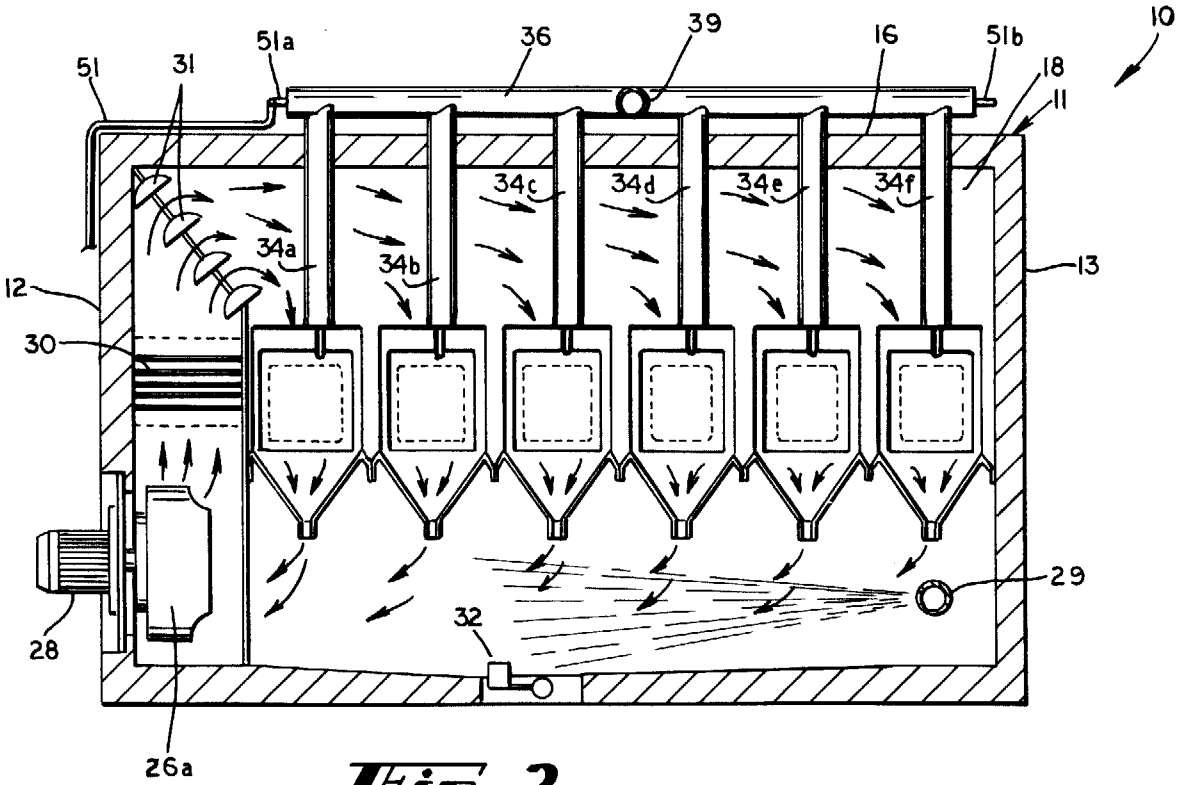
FIG. 2 is a schematic end cross-sectional view of the yarn heat set machine and generally represents the prior art.

Referring now in more detail to the drawings, wherein like numerals indicate like parts throughout the several views, FIG. 1 illustrates a continuous yarn heat set machine 10 which includes a housing 11 having side walls 12 and 13, front wall 14, rear wall 15 and top wall 16. The particular continuous yarn heat set machine illustrated herein is known as a "Suessen" and includes an interior chamber 18 for steam heating yarns that are continuously moved through the heat chamber. A plurality of equally spaced openings such as openings 20*a*, 20*b*, 20*c* and 20*d* are formed in front wall 14 and a plurality of equally spaced openings 21*a*, 21*b*, 21*c*, 21*d*, 21*e* and 21*f* are formed in rear wall 14, with the openings in the front wall being aligned with the openings in the rear wall so as to define a plurality of yarn paths that extend through the housing 11. Conveyor tape systems 22*a*–22*f* extend through the openings of the housing and protrude from opposite ends of the housing, and winding equipment (not shown) functions to wind yarn 24 about each conveyor tape system. Unwinding guides 25*a*–25*f* are positioned at the ends of the conveyor tape systems 22 so that the yarn 24 can be pulled from the conveyor tape systems 22 as the yarn emerges through rear wall 15.

As is conventional with this type continuous yarn heat set machine, circulating fans 26 are located in housing 11 adjacent side wall 12 and are driven by motors 28, while steam nozzle 29 is located adjacent the other side wall 13 and is arranged to direct a flow of steam toward fans 26. Heating elements 30 are located above fans 26, and flow directors or baffles 31 are located above fans 26. The arrangement is such that the steam is projected beneath the paths of movement of the yarn through the housing toward fans 26, and fans 26 induce a flow of air from steam nozzle 29, through fans 26, upwardly about heating elements 30, then about baffles 31, out over the paths travelled by the yarn, and then downwardly through the yarn into the lower portion of the chamber between the steam nozzle 29 and fans 26. The hot gas within the housing is continuously recirculated through the yarns as the yarns continuously move along their respective paths through the housing, causing the yarns to be heat set. A drain 32 is located in the bottom of the housing to drain the condensation from the housing.

A plurality of exhaust stacks 34*a*, 34*b*, 34*c*, 34*d*, 34*e* and 34*f* are located adjacent the inside surface of front wall 14, each with its lower end positioned above an opening 20*a*–20*f*, respectively, and the exhaust stacks extend upwardly from adjacent the paths of the yarn through the top wall 16. Similar exhaust stacks 35*a*, 35*b*, 35*c*, 35*d*, 35*e* and 35*f* are located adjacent the inside surface of rear wall 15 each with its lower end positioned above an opening 21*a*–21*f*, respectively, and the exhaust stacks extend upwardly adjacent the paths of the yarn through the top wall 16. The front stacks 34*a*–34*f* are each connected at their upper ends to front cross manifold 35, while the rear stacks 35*a*–35*f* are each connected at their upper ends to rear cross manifold 38. Header conduit 39 is connected at its ends to the front and rear cross manifolds 36 and 38 at the midpoints of the cross manifolds, and exhaust fan 40 has its inlet in communication through branch conduit 41 with the midpoint of header conduit 39. Fan motor 42 drives the impeller 43 of fan 40 and induces a flow of gas upwardly through each exhaust stack 34*a*–34*f* and 35*a*–35*f*, through each of the front and rear cross manifolds 36 and 38, through header conduit 39, and then outwardly through exhaust conduit 44. With this arrangement, the hot gases of the system are continuously exhausted so that a new supply of steam and air is continuously provided to housing 11, and the finish heat from the yarn is continuously exhausted from the housing. This is conventional in the art.

Figure 3:
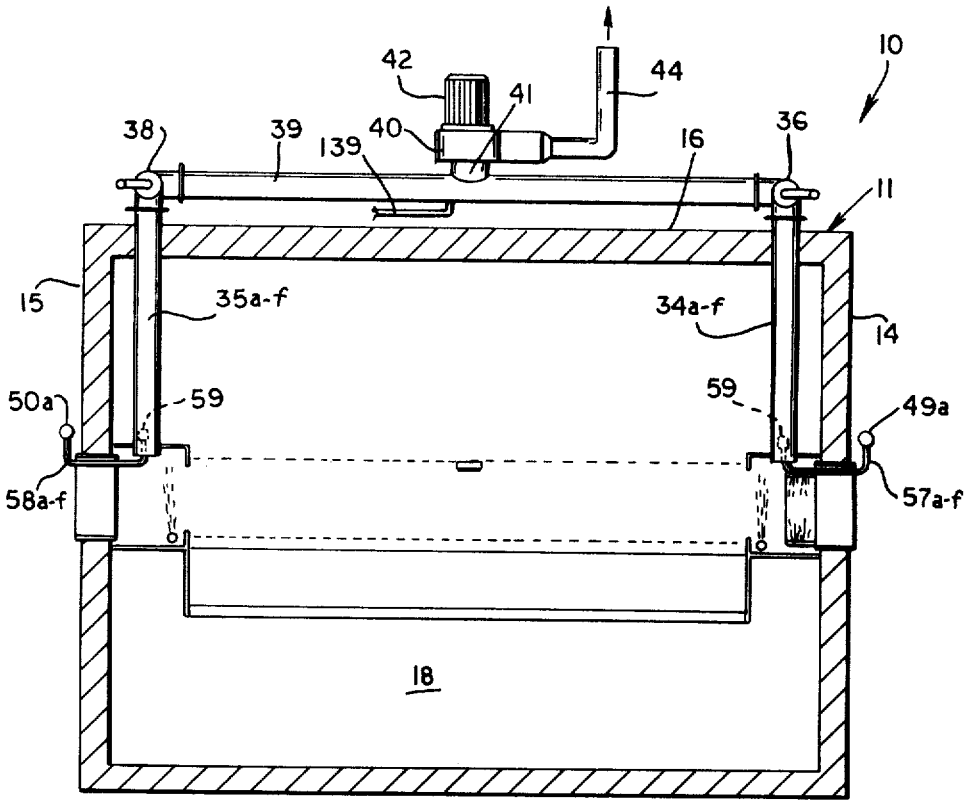
FIG. 3 is a schematic side cross-sectional view of a continuous yarn heat set machine, illustrating the cleaning system.

As best illustrated in FIG. 1, the cleaning system for cleaning the exhaust chambers of the continuous yarn heat set machine 10 comprises a portable control system 46 that is mounted on wheels and is movable from one continuous yarn heat set machine to another, and a cleaning fluid conduit system 48 that is connectable to the portable control system 46. The cleaning fluid conduit system 48 comprises front and rear stacks supply conduits 49 and 50, front and rear cross manifold supply conduits 51 and 52, internal fan supply conduit 54 and external fan supply conduit 55. Front and rear stacks supply conduits 49 and 50 each include a supply header section 49*a* and 50*a*, respectively, each of which extends horizontally along the exterior surface of front wall 14 and rear wall 15 over the openings 20*a*–20*f* and 21*a*–21*f*. U-shaped nozzle conduits such as conduits 57*a* and 57*b* are connected to supply header section 49*a* at spaced intervals along the supply header section and project inwardly through openings 20*a*–20*f* and upwardly into exhaust stacks 34*a*–34*f*, while similar U-shapednozzle conduits 58*a*–58*f* are each connected to supply header section 50*a* at spaced intervals therealong and project inwardly through the openings 21*a*–21*f*, respectively and up into the lower end portions of exhaust stacks 35*a*–35*f*, respectively. Nozzles, such as nozzles 59 of FIG. 3, are positioned on the inner ends of each U-shaped nozzle conduit 57*a*–57*f* and 58*a*–58*f* and are arranged to direct a flow of fluid in an upward direction into the lower end portion of each stack 34*a*–34*f* and 35*a*–35*f*.

Figure 4:
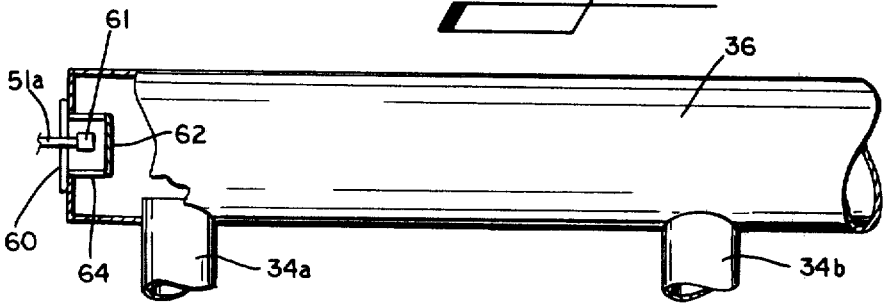
FIG. 4 is a detail illustration of a cross manifold and of the nozzle assembly for injecting the cleaning fluid into the cross manifold.

Front and rear cross manifold supply conduits 51 and 52 each include branch conduits 51*a* and 51*b*, and 52*a* and 52*b* that extend into opposite ends of cross manifolds 36 and 38, respectively. As illustrated in more detail in FIG. 4, each branch conduit such as branch conduit 51*a* extends through a mounting plate 60 attached to the end of the cross manifold, and a nozzle 61 is mounted at the end of the branch conduit. A baffle plate 62 is supported by legs 64 in spaced parallel relationship with respect to mounting plate 60, and when fluid is emitted from a nozzle 61, the baffle plate 62 tends to further disperse the fluid in the end portion of the cross manifold.

Figure 5:
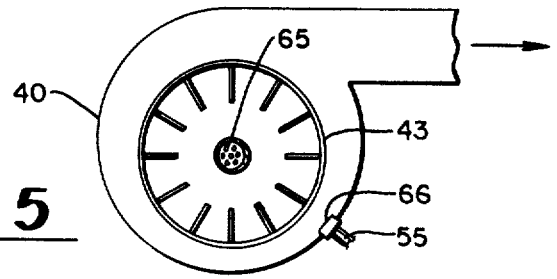
FIG. 5 is a schematic cross-sectional plan view of the fan of the yarn heat set machine, illustrating the nozzles utilized by the cleaning system.

Internal fan supply conduit 54 opens into header conduit 39 at a location immediately beneath the inlet opening of fan 40, and nozzle 65 (FIG. 5) projects toward the fan impeller 43. External fan supply conduit 55 extends into the housing of exhaust fan 40 and includes a nozzle element 66 that projects a spray of cleaning fluid toward the blades of the impeller 43 as the blades move past the nozzle element 66.

The foregoing description illustrates that the cleaning fluid conduit system 48 is arranged to direct cleaning fluid to the lower ends of the exhaust stacks 34*a*–34*f* and 35*a*–35*f*, into the opposite ends of cross manifolds 36 and 38, and into fan 40.

Figure 6:
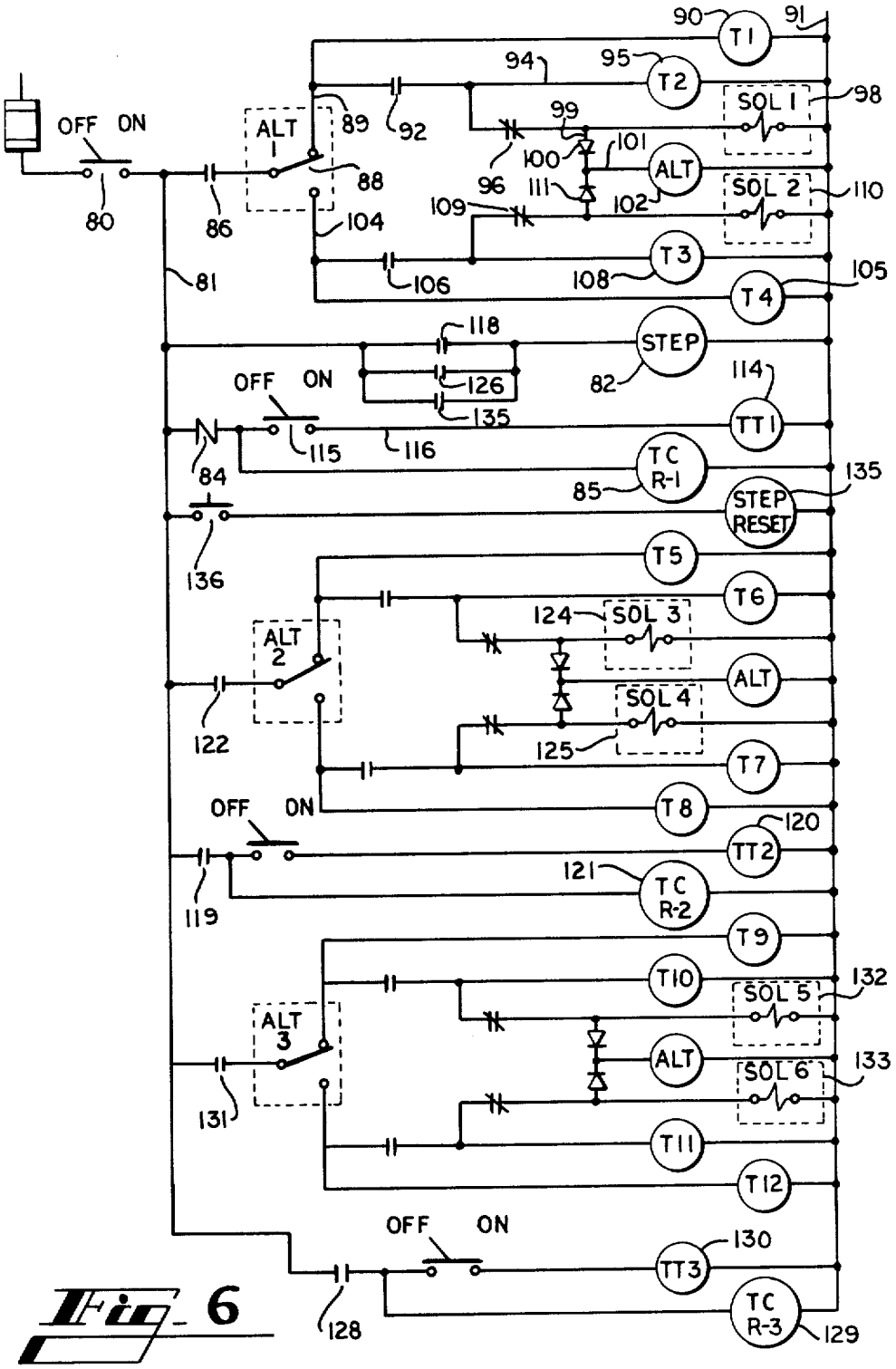
FIG. 6 is an electrical diagram of the control system used for the cleaning system.

As illustrated in FIG. 6, portable control system 46 comprises an on-off switch 80 which connects a source of electrical power to conductor 81. Stepping relay 82 in its start position maintains switch 84 in its closed position, so that when the on-off switch 80 is closed, timer relay 85 is actuated and closes switch 86, to supply power to alternating relay switch 88. When alternating relay switch 88 is in the position illustrated, power is supplied to conductor 89, through timer 90 to ground 91. Timer 90 immediately closes switch 92 so that conductor 94 is energized and begins the operation of timer 95. Normally closed switch 96 is controlled by timer 95, so that switch 96 stays in its closed position so as to open solenoid valve 98. When solenoid valve 98 is energized, it opens a flow of cleaning fluid under pressure to supply hose 69 that is connected to front stacks supply conduit 49, thus supplying cleaning fluid through front stacks supply conduit 49 and its U-shaped nozzle conduits 57*a*–57*f*, to spray cleaning fluid upwardly into the lower open end portions of the stacks 34*a*–34*f*. In the meantime, the closing of switch 92 and the maintaining of switch 96 in its closed condition energizes conductor 99 which, through diode 100 energizes conductor 101 and alternating relay coil 102. When timer 95 times out, normally closed switch 96 is opened, which de-energizes solenoid valve 98 and alternating relay switch coil 102. When solenoid valve 98 is de-energized, it closes the flow of cleaning fluid to supply 69 and to front stacks supply conduit 49.

When coil 102 is de-energized, alternating relay switch 88 is moved to its other position to de-energize conductor 89 and to energize conductor 104. This starts timer 105, and after a short time duration, timer 105 closes normally open switch 106. The closing of switch 106 energizes timer 108, and timer 108 maintains normally closed switch 109 in its closed position until timer 108 times out. Switch 109 supplies power to solenoid valve 110 and through diode 111 and conductor 101 to alternating relay coil 102.

The opening of solenoid valve 110 supplies cleaning fluid under pressure to connector hose 70, thereby charging rear stacks supply conduit 50 with cleaning fluid, so that cleaning fluid is sprayed through U-shaped nozzle conduits 58*a*–58*f* upwardly into the open lower end portions of exhaust stacks 35*a*–35*f*, to clean the exhaust stacks. When timer 108 times out, it opens its normally closed switch 109, thus closing solenoid valve 110 to terminate the flow of cleaning fluid into the lower ends of exhaust stacks 35*a*–35*f*, and alternating relay coil 102 is de-energized. This shifts alternating relay switch 88 back to the position indicated in the drawing, so that solenoid valve 98 will again open after a short time delay. This cycle is repeated as long as switch 86 is closed.

Total timer 114 is also energized upon the closing of on-off switch 80, by power through switch 84, on-off switch 115, conductor 116, to ground, and the setting of total timer 114 controls the total amount of time that solenoid valves 98 and 110 will cycle on and off. Therefore, cleaning fluid is directed into the lower ends of the exhaust stacks 34*a*–34*f* and 35*a*–35*f* in short spurts to supply a quantity of the cleaning fluid to the stacks and to terminate the supply of cleaning fluid to permit the cleaning fluid to coat the surfaces of the exhaust system and then to permit the flow of gas through the exhaust system to exhaust the cleaning fluid from the system.

When total timer 114 times out, it pulses switch 118 of stepping relay 82, causing the stepping relay to open its first switch 84 and to close its second switch 119. This causes solenoid valves 98 and 110 to become dormant and the cleaning cycle for the exhaust stacks 34*a*–34*f* and 35*a*–35*f* has been completed. In the meantime, the closing of step switch 119 energizes the total timer 120 and its timer relay 121, to start the cleaning cycle for cross manifolds 36 and 38. When timer relay 121 is energized, it closes switch 122 to energize an alternating circuit that is identical to the alternating circuit of solenoid valves 98 and 110. Thus, solenoid valves 124 and 125 are alternately energized to alternately supply cleaning fluid to the ends of cross manifolds 36 and 38. As with the upper alternating circuit for solenoids 98 and 110, the middle alternating circuit opens solenoid 124 after a short time duration, and when solenoid 124 is de-actuated, the solenoid 125 is actuated after a short time duration. Thus, cleaning fluid is directed into the ends of cross manifolds 36 and 38 in short spurts, so as to supply a quantity of cleaning fluid to the cross manifolds to coat the surfaces of the system with cleaning fluid and then terminate the supply so that the gases moving through the cross manifolds clear the cross manifolds and header conduit and fan before another spurt of cleaning fluid is injected into the cross manifolds.

When the time elapses for total timer 120, it momentarily closes switch 126 which causes stepping relay 82 to open its second contact 119 and close its third contact. Again, switch 128 energizes timer relay 129 and its total timer 130, thus closing switch 131 and initiating the alternating circuit to solenoid valves 132 and 133. When total timer 130 times out, it momentarily closes switch 135 to stepping relay 82, thus causing stepping relay 82 to open its third contact. This completes the cleaning cycle for the continuous yarn heat set machine 10. In order to reposition stepping relay 82, reset relay 135 is energized by closing its switch 136, and stepping relay is reset back to its number one position.

When the cleaning cycle is to be initiated, it is desirable to maintain the yarn heat set machine in a hot condition, as by continuing the operation of its heating elements, its steam nozzle 29, circulating fans 26 and exhaust fan 40. Usually, the supply of yarn to the heat set machine will be terminated so that the yarn will clear the machine. This only requires a few minutes, so that the machine remains in a relatively stable temperature condition, and gases continue to be exhausted through the exhaust system by exhaust fan 40. When the cleaning fluid is first injected into the exhaust stacks 34*a*–34*f* and 35*a*–35*f*, the cleaning fluid is injected first to front stacks supply conduit 49 and therefore through the U-shaped nozzle conduits 57a–57f, to the lower open end of the exhaust stacks 34a–34f. The cleaning fluid is supplied in a quantity that permits the flow of gases induced by exhaust blower 40 to carry the cleaning fluid upwardly through the hot exhaust stacks and through the cross manifold and header conduit to the fan, and then through the exhaust conduit 44. After the cleaning fluid has been supplied for a short time duration to exhaust stacks 34a–34f, it is then supplied to exhaust stacks 35a–35f for a short time duration and at a rate which permits the gases exhausted through the exhaust system to carry the cleaning fluid through the system. The supplying of the cleaning fluid for short time durations to the exhaust stacks permits the cleaning fluid to clear the exhaust stacks, and the hot exhaust gases are able to maintain the exhaust stacks in a hot condition during the periods when no cleaning fluid is present in the exhaust stacks, between the cycles of supplying the cleaning fluid to the exhaust stacks. Likewise, alternating the supply of cleaning fluid to the cross manifolds permits the cross manifolds to maintain their high temperature. The surge of cleaning fluid through the various conduits tends to substantially drench the surfaces of the conduits with the cleaning fluid, yet the cleaning fluid tends to move on through the system without dripping backwards through the exhaust stacks. It will be noted in FIG. 4 that the upper ends of the exhaust stacks 34a, 34b, etc. protrude upwardly into the cross manifolds so that the cleaning fluid supplied to the ends of the cross manifolds is not likely to drain into the exhaust stacks.

A drain line 139 is located intermediate the ends of header conduit 39 so as to drain any liquid condensate from the header conduit. Similar drain lines can be utilized at other points in the system, as may be necessary.

The cleaning fluid typically will comprise water and soap, with dishwasher soap being suitable. A typical mixture of water and soap would be 1½ gallons of soap and 15 gallons of water, and this quantity would be sufficient for a typical cycle of the cleaning system. An example of a cleaning cycle would be to supply cleaning fluid through the exhaust stacks at the front wall of the housing for two seconds, and after a four second delay, supply cleaning fluid to the exhaust stacks at the rear wall of the housing for two seconds, and after a delay of four seconds, repeat the cycle. The cycle can be repeated for as long as desired, as set by the total timer 114. When the total timer 114 times out, the cleaning fluid will be supplied to cross manifolds, and a typical supply would be for five seconds to one cross manifold, and after an eight second delay, for five seconds to the other cross manifold, and after an eight second delay, to repeat the cycle.

The cleaning liquid is pressurized at approximately 300 pounds per square inch in the cleaning fluid conduit system, and the spray nozzles typically comprise nozzle openings of one-eighth inch for the exhaust stacks and nozzle openings of one-fourth inch for the cross manifolds and exhaust fan. The spray head 65 (FIG. 5) includes a plurality of very small nozzle openings that are arranged to disperse the cleaning fluid toward the blades of the fan impeller 43.

When the cleaning cycle has been completed, yarn can be threaded back through the yarn heat set machine 10 without delay, since the temperature conditions of the machine will have been substantially maintained, and by the time the yarn has been threaded back in the machine, any variation of temperature within the housing 11 will have been stabilized.

While this invention has been described in detail with particular reference to a preferred embodiment thereof, it will be understood that variations and modifications can be effected within the spirit and scope of the invention as described hereinbefore and as defined in the appended claims.

I claim:

1. Apparatus for cleaning a yarn heat setting system of the type including a housing with a plurality of yarn paths extending therethrough, means for circulating steam through the yarn paths, exhaust stacks extending upwardly from each end of each yarn path, a first cross manifold in communication with the exhaust stacks at one end of the yarn paths, a second cross manifold in communication with the exhaust stacks at the other end of the yarn paths, a header conduit in communication with the first and second manifolds, and a fan having an inlet in communication with the header conduit to induce a flow of fluid from the housing in parallel through the exhaust stacks, through the cross manifolds, then to the header conduit and to the fan, the improvement comprising means for directing a spray of cleaning fluid into lower end portions of the exhaust stacks of the heat setting system, means for directing a spray of cleaning fluid into the cross manifolds, and means for directing a spray of cleaning fluid into the fan.

2. The apparatus of claim 1 and wherein said means for directing a spray of cleaning liquid into the lower end portions of the exhaust stacks comprises control means for directing cleaning fluid alternately into the exhaust stacks at one end of each yarn path and then into the exhaust stacks at the other end of each yarn path for a predetermined period, and wherein said means for directing a spray of cleaning fluid along the cross manifolds comprises control means for directing cleaning fluid alternately into one cross manifold and then into the other cross manifold for a second predetermined period after the expiration of the first predetermined period, and wherein said means for directing a spray of cleaning fluid into the fan comprises control means for directing cleaning fluid into the fan for a third predetermined period after the expiration of the second predetermined period.

3. The apparatus of claim 1 and wherein said means for directing a spray of cleaning fluid into the exhaust stacks comprises first cleaning liquid conduit means including a nozzle at the lower portion of each stack at one end of the yarn paths and second cleaning liquid conduit means including a nozzle at the lower portion of each stack at the other end of the yarn paths, control means for moving cleaning fluid through said first cleaning fluid conduit means and its nozzles for a first predetermined period and for moving cleaning fluid through said second cleaning fluid conduit means and its nozzles for a second predetermined period after said first predetermined period.

4. Apparatus for cleaning a yarn heat setting machine of the type including a housing with a plurality of yarn paths extending therethrough, means for recirculating steam through the yarn paths, and exhaust stacks at the ends of the yarn paths connected to a common exhaust conduit system for exhausting gases from the yarn paths in parallel through the exhaust stacks and then through the common exhaust conduit system, the improvement therein of spray means for directing a spray of cleaning liquid into the lower end of each exhaust stack, and control means for actuating said spray means for predetermined durations whereby the cleaning liquid coats the inside surfaces of the exhaust stacks and coats the inside surfaces of the common exhaust system as the gases are exhausted through the exhaust stacks and the common exhaust system.

5. A method of cleaning a yarn heat setting system of the type including a housing with a plurality of yarn paths extending therethrough, means for circulating steam through the yarn paths, exhaust stacks extending upwardly from each end of each yarn path, a first cross manifold in communication with the exhaust stacks at one end of the yarn paths, a second cross manifold in communication with the exhaust stacks at the other end of the yarn paths, a header conduit in communication with the first and second cross manifold, and a fan having an inlet in communication with the header conduit to induce a flow of fluid from the housing in parallel through the exhaust stacks, through the cross manifolds to the header conduit and to the fan, the improvement comprising the steps of inducing a flow of gas upwardly through the exhaust stacks and through the cross manifolds and the header with the fan, and directing a flow of cleaning fluid into the lower ends of the exhaust stacks in a predetermined volume per time interval whereby the cleaning fluid moves with the flow of gas upwardly through the exhaust stacks, through the cross manifolds, through the header conduit and through the fan.

6. The method of claim 5 and wherein the step of directing a flow of cleaning fluid into the lower ends of the exhaust stacks comprises alternately directing a flow of cleaning fluid into some of the exhaust stacks and then into others of the exhaust stacks for a predetermined period.

7. The method of claim 5 and wherein the step of directing a flow of cleaning fluid into the lower ends of the exhaust stacks comprises alternately directing a flow of cleaning fluid first into the exhaust stacks at one end of each yarn path and then into the exhaust stacks at the other end of each yarn path for a predetermined period, and further including the steps of alternately directing a flow of cleaning fluid first into one cross manifold and then into the other cross manifold for a second predetermined period after the first predetermined period, and directing a flow of cleaning fluid into the fan for a third predetermined period after the second predetermined period.

* * * * *